US009079372B1

(12) United States Patent
Hershman et al.

(10) Patent No.: US 9,079,372 B1
(45) Date of Patent: Jul. 14, 2015

(54) COMPACTOR SYSTEM FOR SELF-SERVE KIOSK

(75) Inventors: Stephen Hershman, Edmonds, WA (US); Keith Rettig, Redmond, WA (US)

(73) Assignee: The Shred Stop, Lynnwood, WA (US)

( * ) Notice: Subject to any disclaimer, the term of this patent is extended or adjusted under 35 U.S.C. 154(b) by 561 days.

(21) Appl. No.: 13/418,158

(22) Filed: Mar. 12, 2012

Related U.S. Application Data

(60) Provisional application No. 61/451,881, filed on Mar. 11, 2011.

(51) Int. Cl.
*B30B 1/18* (2006.01)
*B30B 9/30* (2006.01)

(52) U.S. Cl.
CPC ..... *B30B 9/3035* (2013.01)

(58) Field of Classification Search
CPC B30B 9/3035; B30B 9/3007; B02C 18/0007; B02C 2018/0061
USPC ..... 100/94, 97, 98 R, 117, 145, 146, 215, 100/226, 229 R, 229 A, 240, 245; 241/25, 241/34, 36, 101.741, 101.2, 225, 236, 100
See application file for complete search history.

(56) References Cited

U.S. PATENT DOCUMENTS 3,765,148 A * 10/1973 Ippolito et al. ..... 53/527
3,867,880 A * 2/1975 Bourgeois ..... 100/226
3,890,890 A * 6/1975 Hennells ..... 100/48
4,009,838 A * 3/1977 Tashman ..... 241/99
4,192,467 A 3/1980 Hatanaka
4,638,730 A * 1/1987 Bonacorsi ..... 100/229 A
5,261,614 A 11/1993 Schwelling
5,704,558 A 1/1998 Arrott
6,491,245 B1 * 12/2002 Rajewski ..... 241/223
7,213,777 B2 5/2007 Podrovitz
7,500,627 B2 3/2009 Park et al.
2003/0201353 A1 10/2003 Lefrancois et al.
2005/0051650 A1 3/2005 Watanabe
2007/0063082 A1 3/2007 Coleman
2008/0257993 A1 10/2008 Cole et al.
2010/0308138 A1 * 12/2010 Freda ..... 241/25

OTHER PUBLICATIONS

"Realtime Shredding Expands to Texas", Jul. 2006, Publisher: Digital Screenmedia Association, Published in: US.
"Self-Service Shredding Kiosks Deployed by Colorado Bank", Feb. 2007, Publisher: Digital Screenmedia Association, Published in: US.
Darren Murph, "Self-Service Shredder Kiosk Enables Pay-Per-Use Shredding", May 2007, Publisher: Engadget, Published in: US.

* cited by examiner

*Primary Examiner* — Jimmy T Nguyen
(74) *Attorney, Agent, or Firm* — David G. Woodral, Esq.; Fellers, Snider, Blankenship, Bailey & Tippens, P.C.

(57) ABSTRACT

A device with a shredder, a compactor that accepts shredded material from the shredder, and a refuse bin in a cooperating relationship with the compactor for accepting shredded material from the compactor and retaining the shredded material inside the bin in a compacted form.

3 Claims, 8 Drawing Sheets

COMPACTOR SYSTEM FOR SELF-SERVE KIOSK

CROSS REFERENCE TO RELATED APPLICATIONS

This application claims the priority of U.S. Provisional Patent Application No. 61/451,881 entitled "SELF-SERVICE SHREDDER KIOSK," filed Mar. 11, 2011, the contents of which are hereby incorporated by reference.

FIELD OF THE INVENTION

This disclosure relates to compactor systems in general and, more particularly, to a compactor for a self-serve kiosk.

BACKGROUND OF THE INVENTION

Identity theft has become one of the major problems of the information age. In addition to issues related to cyber security, the difficulty with properly disposing of sensitive written materials persists. Identity thieves have been known to snoop through trash in order to gain sensitive personal details of their targets.

Personal shredders have been one possible way to address the issue of personal information appearing on printed documents. However, the relatively light duty cycle of most inexpensive personal models may render them unsuitable for all but the most lightweight needs. Furthermore, such models can be noisy and may also be dangerous to children and pets. Users may also tend to "save up" their documents to shred, which can result in exceeding the capacity of personal shredders, leading to overheating and even failure. Personal shredders may also lack the capacity to properly shred old credit cards, compact discs, and bound material.

Moving up to a higher capacity shredder can address some of these issues but may create others. Higher capacity generally means larger physical size and a great deal of shredded refuse to handle when the device fills up. Paper can expand to greater than ten times its original volume when shredded. Thus, for any shredder, space required to maintain the shredded refuse is a limiting factor for successful implementation.

What is needed is a system and method for addressing the above, and related, issues.

SUMMARY OF THE INVENTION

The invention of the present disclosure, in one aspect thereof, comprises a compactor that accepts shredded material, and a removable refuse bin in a cooperating relationship with the compactor for accepting shredded material from the compactor and retaining the shredded material inside the bin in a compacted form. The refuse bin provides a wedge contour inside thereof on a side opposite the compactor and facing the compactor that disperses compaction forces away from the side opposite the compactor.

The device may include a retaining mechanism affixed in a substantially rigid relationship with respect to the compactor, the retaining mechanism providing at least one support member traversing underneath a portion of the refuse bin to the side opposite the compactor and provide resistance against compaction forces acting to separate the refuse bin from the compactor. The retaining mechanism may comprise a pair of horizontal support members connected by at least one cross member and each having a vertical edge on an end thereof for contacting a side of the refuse bin. The retaining mechanism may be biased against a bottom of the refuse bin such that the vertical edges continuously guard against movement of the refuse bin away from the compactor.

The device may provide a plurality of horizontal rails rigidly supporting the bin such that torque forces imparted to the bin by the compactor are prevented from being transmitted by the bin to a resting surface. In some embodiments, the compactor is below and offset from the shredder to accept the bin in the cooperating relationship therewith, below the shredder. The device may include a hopper for directing the shredder material into the compactor from above, and may also include a conveyor that moves shredded material from the shredder to the hopper. In some cases the compactor is an auger compactor, and it may compact the shredded material into the refuse bin in a substantially horizontal direction.

The invention of the present disclosure, in another aspect thereof, comprises a device with a shredder that accepts unshredded material at a consumer kiosk and shreds it to produce shredded refuse. The device includes a removable refuse bin and a horizontal auger compactor that accepts the shredded refuse and compacts it into the refuse bin. A retainer mechanism retains the refuse bin in a substantially rigid relationship with respect to the compactor such that the refuse bin is not displaced from the compactor under compaction forces generated by the compactor. A set of substantially horizontal support rails support the refuse bin and prevent torque applied to the refuse bin from being imparted to a surface on which the kiosk rests. The refuse bin has a first side in a cooperating relationship with the compactor to accept compacted refuse, and has an internal contour opposite the compactor that diverts compaction forces laterally from the compactor.

Some embodiments of this device include a frame to which the compactor and retainer mechanism are rigidly mounted. The retainer mechanism may comprise at least one elongate support mounted to the frame by an axle on a first end thereof, and having a hook on a second end thereof that engages the refuse bin. The elongate support may traverse underneath the refuse bin and engages the bin along a bottom edge thereof. The elongate support may be biased upward toward a bottom of the refuse bin and provide a foot operable release step such that a user may depress the support and release the refuse bin.

In some cases the device further comprises a rigid frame that retains the shredder above the compactor. The compactor may be displaced toward a lower side of the frame such that the refuse bin fits removably within the frame. Some embodiments will also have a hopper attached to the compactor that funnels the shredded refuse in to the compactor, and a conveyor that accepts the shredded refuse from the shredder and moves it to the hopper.

The invention of the present disclosure, in another aspect thereof, comprises a method including providing a horizontal compactor within a consumer kiosk, providing a retention mechanism for accepting and retaining a refuse bin in a fixed relationship with respect to the compactor, compacting refuse into the bin from the compactor, and supporting the refuse bin horizontally during compaction to prevent torque forces from being transmitted outside the kiosk.

The method may also include providing a refuse bin within the kiosk that interfaces with the compactor on a first side thereof to receive shredded refuse and has in internal contour on a second side, opposite the compactor, that diverts compaction forces away from the second side. A retention mechanism may be provided that traverses underneath the refuse bin from proximate the compactor to a side of the bin opposite the compactor and engages a lower portion of the opposite side. The retention mechanism may be biased toward the bin, the bias being such that it may be overcome with foot pressure on the retention mechanism to allow removal of the bin from the compactor.

DETAILED DESCRIPTION OF THE PREFERRED EMBODIMENTS

In various embodiments, the present disclosure describes a device operating as a vending kiosk that provides shredding services. For a vending shredder to be commercially viable it must occupy a footprint small enough that it may be deployed in retail areas. It must also be able to retain enough collected material that frequent emptying or interruption of service is avoided. Unfortunately, shredded paper is approximately 10 times more voluminous than non-shredded paper. Therefore a compaction system may be required in order to increase the density and minimize the volume occupied by shredded paper waste.

Figure 1:
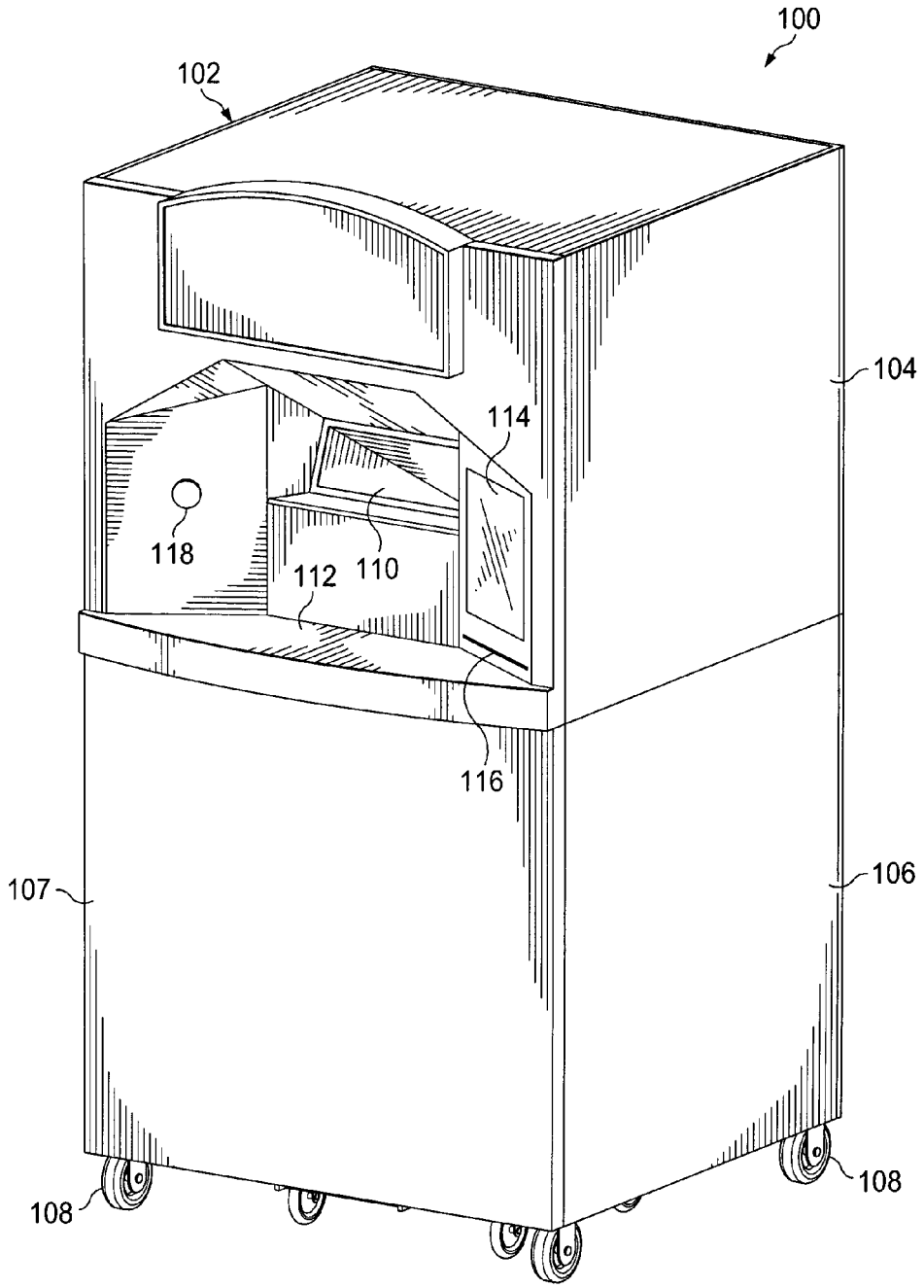
FIG. 1 is a perspective view of a shredder kiosk according to aspects of the present disclosure.

Referring now to FIG. 1, a perspective view of a shredder kiosk according to aspects of the present disclosure is shown. In one embodiment, the shredder kiosk 100 includes a cabinet 102 that may be considered as being divided into an upper cabinet 104 and a lower cabinet 106. The cabinet 102 may be made from a plastic, metal, or composite material suitable to protect the internal components and to protect customers from injury. In some embodiments, the finish of the cabinet 102 may be UV resistant and/or weather proof, depending upon the installation location of the kiosk 100. The cabinet 102 may be mounted on wheels 108. This may allow for easy movement of the kiosk 100 in locations where security is not of the highest concern. In other embodiments, one or more of the wheels 108 may be lockable.

The upper cabinet 104 provides a number of implements to interact with a customer or user of the kiosk 100. In the present embodiment, a feed chute 110 providing access from outside the kiosk 100 to an internal shredder can be seen. An exterior work surface 112 may be provided to allow a customer the ability to organize material for shredding, and/or place heavy items before they are fed into the feed chute 110.

The lower cabinet 106 provides a door 107 that allows easy access to the interior thereof to remove or exchange the refuse bin 212, described below. The door 107 may be lockable and may also provide a tamper alarm.

In one embodiment, a customer or user will interact with the kiosk 100 by a touch screen 114. The touch screen 114 may be pressure sensitive, capacitive, or it may rely on another touch screen technology. In other embodiments, a separate keyboard or other input device may be used with a touch screen or a traditional display panel. In the present embodiment, a card slot 116 is provided for accepting credit cards or other payment methods. Some embodiments may also provide a receipt printer.

Although danger or chance of injury by a customer or user is minimized by the various designs of the present disclosure, additional safety measures may be implemented. In the present embodiment, an emergency stop button 118 is provided in a convenient and easy reachable location to allow the internal shredder to be immediately deactivated and/or reversed in case of emergency. In other embodiments, safety flaps or other covers may be utilized to further separate the user from any existing danger due to the internal shredding mechanism.

Figure 2:
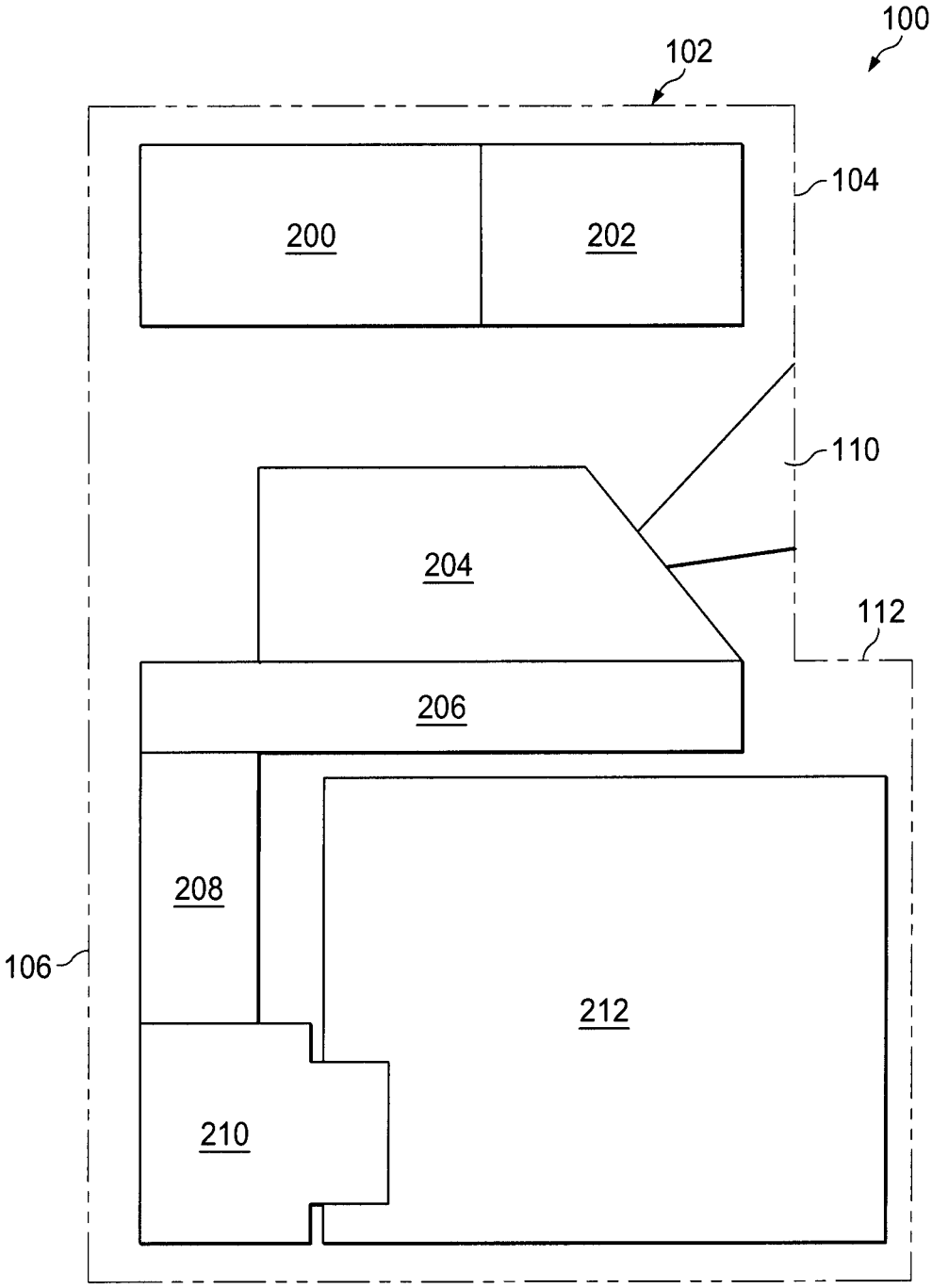
FIG. 2 is a schematic diagram of the shredder kiosk of FIG. 1.

Referring now to FIG. 2, a schematic diagram of the shredder kiosk 100 of FIG. 1 is shown. Here the upper cabinet 104 can be seen integrated with the lower cabinet 106 and the various locations of the internal componentry is shown. The work surface 112 can be seen adjacent to the feed chute 110 that feeds into an internal shredder 204. The shredder 204 may be electrically powered and may be a high-capacity, industrial-grade shredder. In some embodiments, the shredder 204 will be capable of shredding not only paper but also credit cards, compact disks, binders, and/or other data storage devices. In addition to having a large capacity and providing for heavy duty use, the shredder 204 may also be of a high duty cycle variety such that the shredder 204 can be used for many hours a day continuously without substantial interruptions in service.

As the shredder 204 accepts material for shredding, shredded refuse will be created in an area underneath the shredder 204. This refuse may land on a conveyor system 206. The conveyor system 206 may be a belt-driven apparatus designed to transport shredded refuse from the location of the shredder substantially central within the cabinet 104 to a rearward location within the cabinet 102. In the present embodiment, a hopper 208 is provided near the rear of the cabinet 102 for funneling the shredded refuse from the conveyor 206 into a compactor 210. As will be explained in greater detail below, the compactor 210 may be electrically powered and may be an auger-based horizontal compactor.

In the present embodiment, the compactor 210 delivers shredded refuse into a refuse bin 212. Shredded refuse will accumulate in the bin 212 where it will become compacted under the force of the compactor 210. Thus, the bulky shredded refuse will be reduced to a much more dense and substantially solid state. This will enable the kiosk 100 to have a large amount of system up time between emptying or changing of the refuse bin 212.

A computer system 202 may also be provided for interacting with the user via the control panel 114, for interfacing with remote servers, and for other needed functionality. The computer 202 may implement the overall operation of the shredder kiosk 100 and control customer interaction. The computer 202 may also record data regarding usage and other information, and provide the means for shutting down the kiosk 100 in the event of a malfunction. It is also understood that some type of data uplink, such as internet access, may be needed to enable the kiosk 100 to adequately process payments and customer information It is understood that various electrical connections will be necessary within the kiosk 100 to enable the computer and to activate and deactivate the shredder and compactor. A separate control system 200 may be included within the cabinet 102. The control system may interface with the computer 202 and provide for control of various power relays to the components of the system 100.

Figure 3:
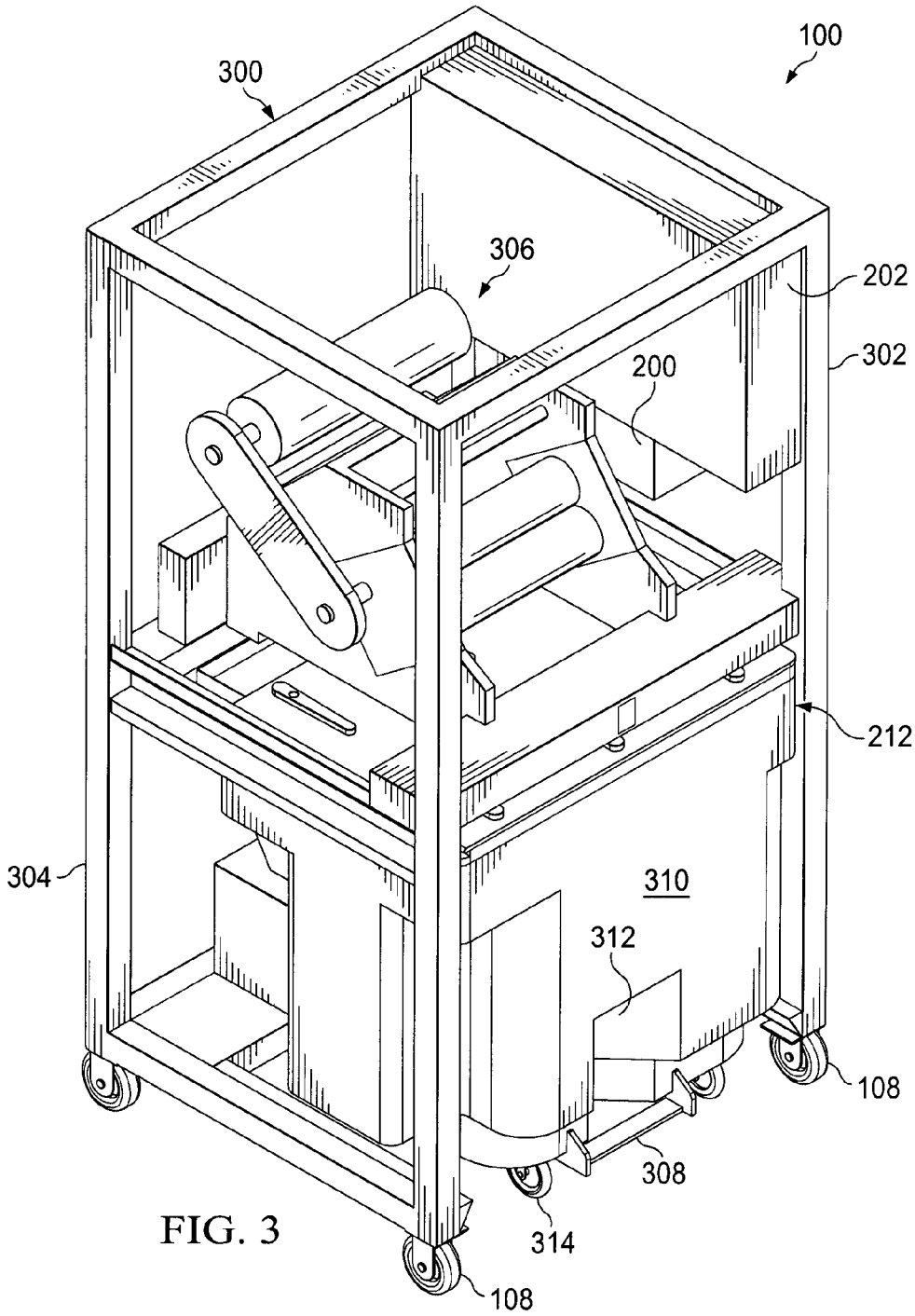
FIG. 3 is a perspective cutaway view of the shredder kiosk of FIG. 1.

Referring now to FIG. 3, a perspective cutaway view of the shredder kiosk 100 is shown. In this view, any outer coverings or skins on the cabinet 102 are not shown so that the internal componentry can be better appreciated. It can be seen that, internally, the kiosk 100 comprises a frame 300. The frame 300 may be steel or a polymer or another suitably rigid and resilient material to support the internal components and provide an adequate foundation for anchoring the compactor 210 and the refuse bin 212. In the present embodiment, an upper frame 302 can be seen housing the shredder 306. Beneath the shredder 306, the conveyor system 206 moves the shredded refuse over the top of the refuse bin 212 to the rear of the kiosk 100. A lower frame 304 houses the refuse bin 212. Here the refuse bin 212 can be seen to comprise a tub 310 having an integrated wedge contour 312 on a lower portion of the front side thereof. The wedge contour 312 can be seen from the outer view of FIG. 3 but, in the present embodiment, is of primary importance inside the bin 212 where it provides for dispersion of internal compaction forces within the bin 212.

The bin 212 may be a metal or polymer product that may be cast, injection molded, roto-molded, or produced by other means. The wedge contour 312 may be integrally molded with the tub 310 or could be formed after the tub 310 is complete. The wedge contour 312 may not necessarily be shaped like a wedge. However, it provides an internal diversion of the large forces generated from the compactor 210, thereby preventing bulging or failure of the tub 310. As compaction forces are diverted within the bin 212, all of the shredded refuse within the bin 212 may become compacted.

The bin 212 may become quite heavy when it is full of compacted, shredded refuse. Therefore, wheels 314 may be provided that allow the refuse bin 212 to be wheeled into and out of the kiosk 100. A series of guide rails or other internal mechanisms of the kiosk 100 ensure that the refuse bin 212 is properly aligned. In the present embodiment, a retention mechanism 308 is provided that prevents movement of the refuse bin 212 out of or away from the kiosk 100 in response to compaction forces.

Figure 4:
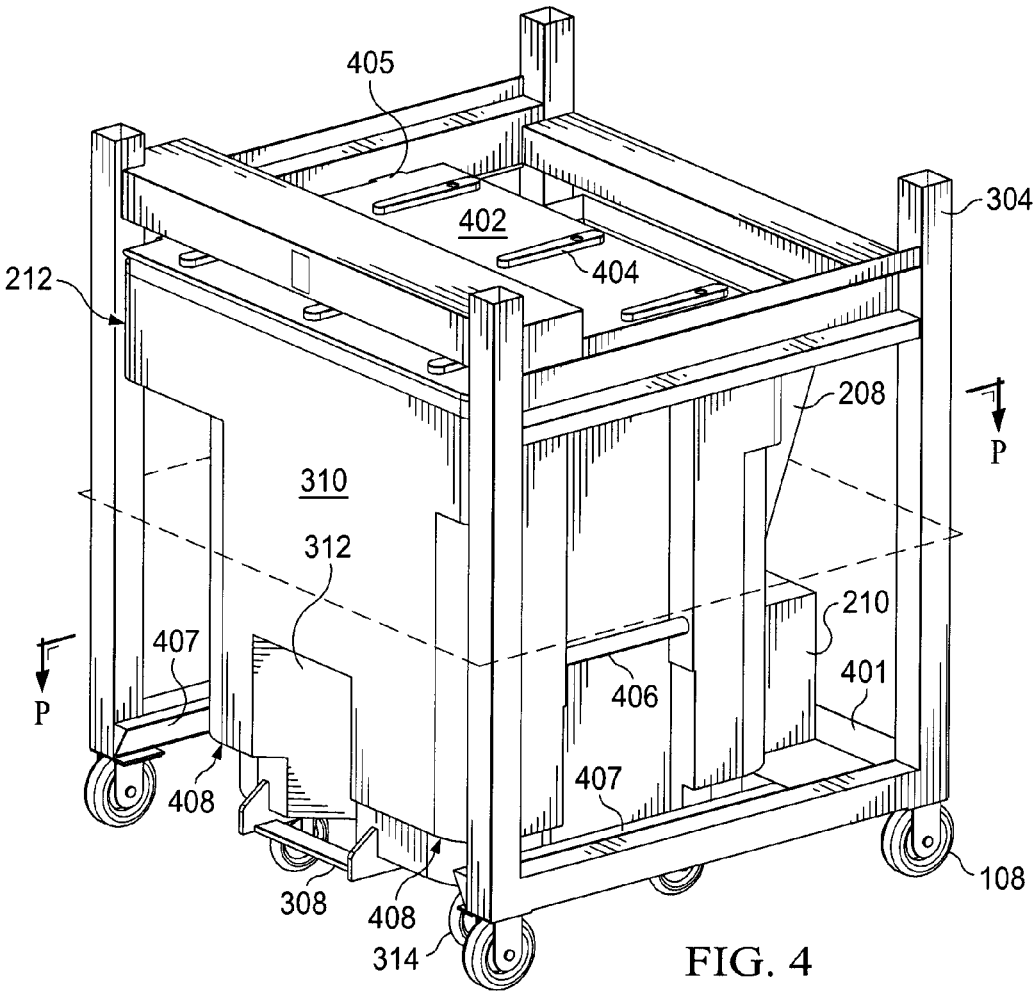
FIG. 4 is a cutaway perspective view of a lower portion of the shredder kiosk of FIG. 1.

Referring now to FIG. 4, a cutaway perspective view of a lower portion of the shredder kiosk of FIG. 1 is shown. The view of FIG. 4 is rotated such that the relationship between the refuse bin 212 and the compactor 210 can be more easily appreciated. Also visible in this view is the hopper 208 which feeds shredded refuse from the conveyor 206 into the compactor 210. From this viewpoint, it can also be appreciated that the refuse bin 212 fits compactly with the kiosk 100, entirely within a lower portion of the kiosk 100. In order to provide solid mounting locations for the compactor 210 and other components, a sub-frame 401 may be provided as a part of the lower frame 304.

From the viewpoint of FIG. 4, the retention mechanism 308 can be seen traveling below the tub 310, which may be elevated off the ground by the wheels 314. In the present embodiment, the compactor 210 is mounted relatively low within the lower frame 304 and thus the horizontal compaction forces emanating from the compactor 210 and into the refuse bin 212 will also exist primarily relatively low within the kiosk 100. In such an embodiment, the wedge shaped contour 312 need only exist relatively low and opposite to the compactor 210. This configuration also allows the retention mechanism 308 to engage the refuse bin 212 primarily along a lower portion thereof, proximate the wedge contour 312, and on an opposite side from the compactor 210.

The refuse bin 212 may have a lockable lid 402 attached to the tub 310 by hinges 405. In the present embodiment, a locking mechanism is provided that is actuatable by the plurality of levers 404 on the lid 402. In some embodiments, a locking mechanism on the lid 402 will prevent the lid from open in response to compaction forces within the bin 212.

The lower frame 304 may incorporate horizontal rails 408 that are situated on the interior of the kiosk 100 and rigidly attached to the frame 304. During compaction, the bin 212 may engage with the rails 407 in a manner to counter torque caused by compaction. In this manner, the bin 212 is preventing from impart forces onto the surface on which the kiosk 100 rests, and the kiosk 100 is prevented from becoming unbalanced due to the force of compaction. The bin 212 may be provided with indentations 408 of sufficient depth that may allow the bin 212 to rest on the rails 407 when placed in the kiosk 100

Figure 5:
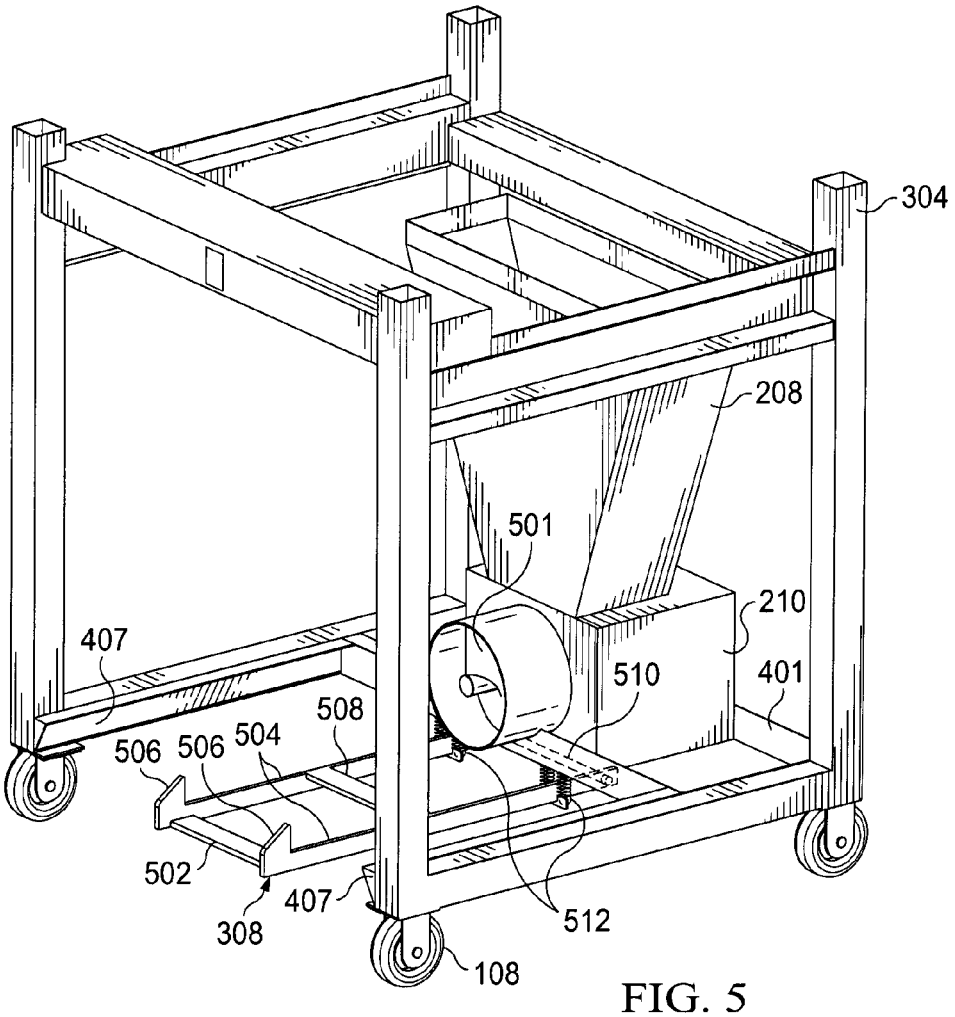
FIG. 5 is a cutaway perspective view of FIG. 4, with the refuse bin removed.

Referring now to FIG. 5, a cutaway perspective view of FIG. 4, absent the refuse bin 212, is shown. From this viewpoint, an auger 501 that forms a portion of the compactor 210 can be seen. In the present embodiment, it is this auger 501 that compacts the shredded refuse into the bin 212. The retention mechanism 308 can be seen in to comprise several additional sub-components. For example, there are two elongate supports 504 proceeding from the sub-frame 401 to a front of the kiosk 100. The supports 504 are each provided with a hook or edge 506 for interacting with and retaining the lower portion of the refuse bin 212. In the present embodiment, the supports 504 are interconnected by a step 502 and a second cross bar 508. These may serve to provide structural rigidity to the retention mechanism 308. The step 502 allows a user to release the refuse bin 212 from the kiosk 100 by foot pressure that displaces the retention mechanism 308 down below the bin 212, allowing the bin 212 to be wheeled out.

In the present embodiment, it can be seen that a portion of the retaining edges 506 is slanted to allow a refuse bin to be easily inserted but then move back into a retaining position when the bin 212 has been substantially completely inserted into the kiosk 100. In the present embodiment, the retention mechanism 308 is mounted to the sub-frame 401 on an axle 510. This allows the forward end of the retention mechanism 308 to elevate and depress while the back end remains substantially in place. In some embodiments, a biasing mechanism such as a set of coil springs 512 serves to bias the retention mechanism 308 upward. In this configuration, the natural inclination of the retention mechanism 308 will be to lock against the refuse bin 312 and prevent its movement away from the horizontal forces produced by the compactor 210.

Figure 6:
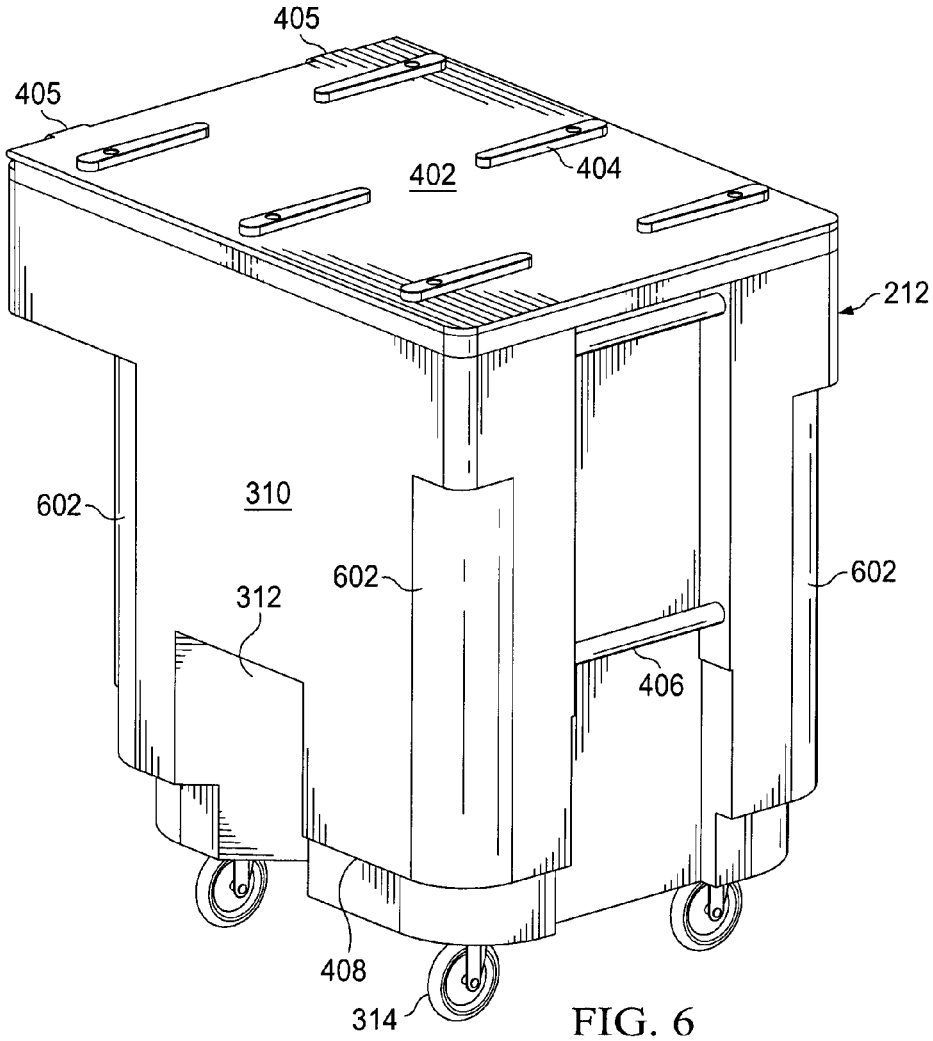
FIG. 6 is a perspective view of a first side of a shredder refuse bin according to aspects of the present disclosure.

Referring now to FIG. 6, a perspective view of a front side of the shredder refuse bin 212 according to aspects of the present disclosure is shown. Previously described aspects and features of the refuse bin 212 will not be repeated. However, it will be appreciated that the general outward shape of the tub 310 may be designed for convenience in handling and/or emptying the bin 212. For example, the levers 404 may be machine operable to release the lid 402 from a locked position in order to allow for automated processing and emptying of the bin 212. Additionally, recesses 602 or lifting interface mechanisms 406 may be provided at various locations on and along the tub 310 to allow for automated grasping mechanisms to easily handle and manipulate the bin 212. In this manner, a number of bins 212 could be utilized interchangeably with the kiosk 100. As each bin 212 becomes full, it may be removed from the kiosk 100 by a technician or other employee and wheeled to an area to await emptying or further processing. When the bin 212 has been emptied of the shredded refuse, it may be placed back in the kiosk or placed in a holding area until needed.

Figure 7:
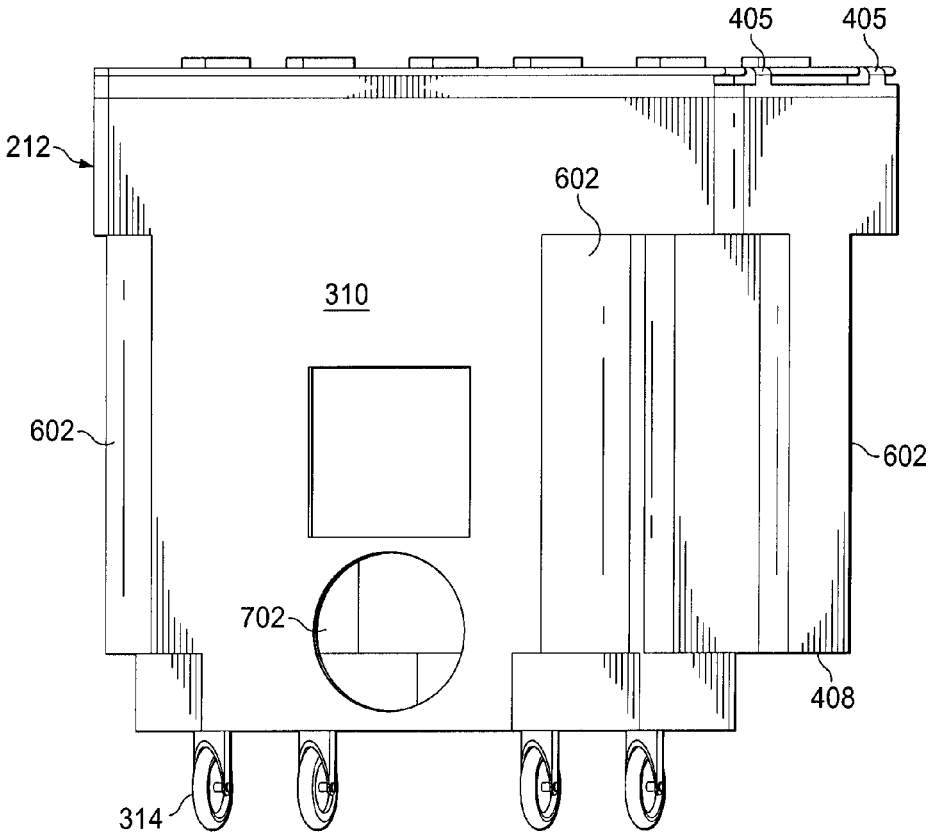
FIG. 7 is a perspective view of the opposite, second side of the shredder refuse bin of FIG. 6.

Referring now to FIG. 7, a perspective view of the opposite side of the shredder refuse bin 212 is shown. From this viewpoint, a compactor fitting 702 can be seen. This fitting will be sized to accommodate and interfit with the compactor 210. In some embodiments, this may be a closeable hole. In other embodiments, a trap door or spring-loaded iris mechanism may be utilized to automatically prevent escape of compacted refuse within the bin 212 from falling or being pushed out when the bin 212 is removed from the kiosk 100.

Figure 8:
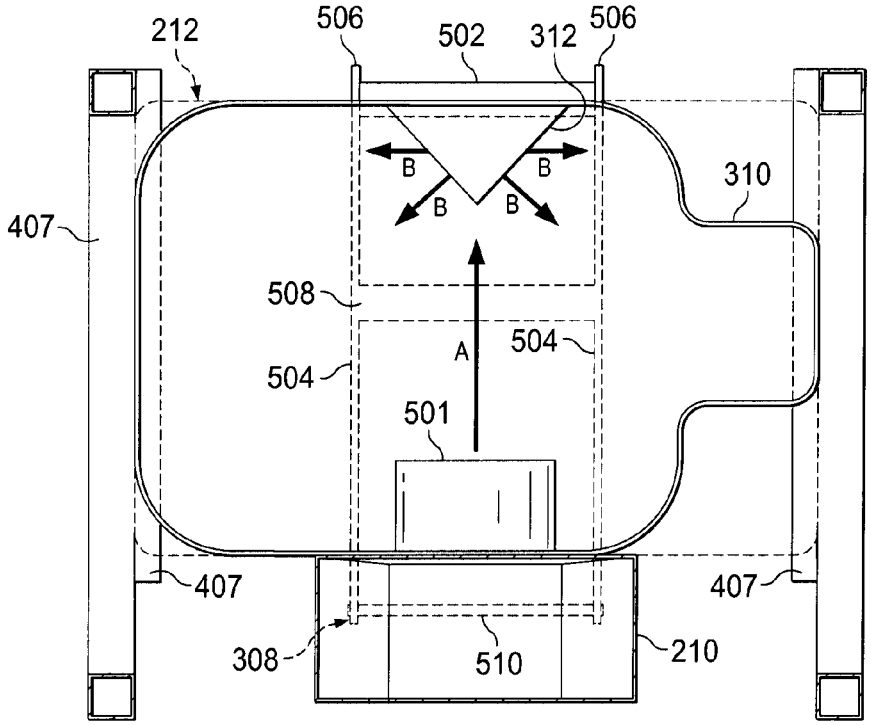
FIG. 8 is a superior view of the system shown in FIG. 4, taken along the plane P.

Referring now to FIG. 8, a superior view of the compactor system 100 taken along the plane P of FIG. 4 is shown (e.g., looking into the tub 310). Not all components are shown in this view in order to focus on particular aspects of the device 100. The rails 407 which serve to stabilize the bin 212 or tub 310 can be seen on opposite sides of the tub 310. These provide support for the weight of the tub 310 as well as providing a counter to torque that may be imparted to the tub by the compactor 210. In the present embodiment, the compactor 210 can be seen to protrude partially into the tub 310 when the bin 212 is fully secured inside the kiosk 100.

On an opposite side from the compactor 210 are the retaining edges 506 on the supports 504 of the retaining mechanism 308. Thus compression forces into the bin 212 will be counteracted by the retention mechanism 308 to prevent the bin 212 from being pushed away from, or off of, the compactor 210. During compaction operations, various forces will be introduced into the bin 212 including torque forces previously mentioned, as well as straight line compaction forces exemplified by the arrow A. Shredded refuse that is being compacted into the bin 212 will encounter the wedge member 312 and be diverted in various directions within the bin 212 as exemplified by the arrows B.

It is understood that, in operation, from the consumer's point of view there are many possible modes of operation of the shredder kiosk 100. In one embodiment, a user will swipe a credit or debit card and interact with the touch screen to input any additional needed information to pay for a predetermined amount of time with the kiosk 100. As the shredder kiosk 100 is utilized, time is deducted from the balance paid for by the consumer. When the time is completely exhausted, the user may, of course, purchase additional time for additional shredding services. In another embodiment, the user's credit or debit card may be pre-authorized by a set amount, but may only be charged for the actual time used when the transaction is complete. In yet another embodiment, a user may purchase a pass that is good for use with the kiosk 100 over a period of time, such as a week or month. In this case, use time need not necessarily be tracked for billing purposes, but the card slot and touch screen may still be utilized to verify the current subscription of the user.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A device comprising:

a compactor that accepts shredded material; and a removable refuse bin in a cooperating relationship with the compactor for accepting shredded material from the compactor and retaining the shredded material inside the bin in a compacted form;

wherein the refuse bin provides a wedge contour inside thereof on a side opposite the compactor and facing the compactor that disperses compaction forces away from the side opposite the compactor; and wherein the compactor is below and offset from a shredder to accept the bin in the cooperating relationship therewith, below the shredder.

2. A device comprising:

a compactor that accepts shredded material; and a removable refuse bin in a cooperating relationship with the compactor for accepting shredded material from the compactor and retaining the shredded material inside the bin in a compacted form; and a hopper for directing the shredded material into the compactor from above wherein the refuse bin provides a wedge contour inside thereof on a side opposite the compactor and facing the compactor that disperses compaction forces away from the side opposite the compactor; and wherein the compactor is below and offset from a shredder to accept the bin in the cooperating relationship therewith, below the shredder.

3. A device comprising:

a compactor that accepts shredded material; and a removable refuse bin in a cooperating relationship with the compactor for accepting shredded material from the compactor and retaining the shredded material inside the bin in a compacted form;

wherein the refuse bin provides a wedge contour inside thereof on a side opposite the compactor and facing the compactor that disperses compaction forces away from the side opposite the compactor;

wherein the compactor is an auger compactor; and wherein an auger of the compactor compacts the shredded material into the refuse bin in a substantially horizontal direction.

* * * * *